US008066133B2

(12) United States Patent
Takamatsu et al.

(10) Patent No.: US 8,066,133 B2
(45) Date of Patent: Nov. 29, 2011

(54) SYNTHETIC RESIN CAP, CLOSING DEVICE, AND CONTAINER-PACKED BEVERAGE

(75) Inventors: Koichi Takamatsu, Urayasu (JP); Masahito Nishijima, Kuki (JP)

(73) Assignee: Closure Systems International Japan, Limited, Tokyo (JP)

( * ) Notice: Subject to any disclaimer, the term of this patent is extended or adjusted under 35 U.S.C. 154(b) by 709 days.

(21) Appl. No.: 10/554,578

(22) PCT Filed: Jul. 28, 2004

(86) PCT No.: PCT/JP2004/011120
§ 371 (c)(1),
(2), (4) Date: Oct. 27, 2005

(87) PCT Pub. No.: WO2005/028328
PCT Pub. Date: Mar. 31, 2005

(65) Prior Publication Data

US 2006/0255002 A1 Nov. 16, 2006

(30) Foreign Application Priority Data

Sep. 19, 2003 (JP) ..... 2003-328992

(51) Int. Cl.
*B65D 41/04* (2006.01)
*B65D 51/16* (2006.01)

(52) U.S. Cl. ..... 215/344; 215/307

(58) Field of Classification Search ..... 215/343, 215/344, 329, 341, 307
See application file for complete search history.

(56) References Cited

U.S. PATENT DOCUMENTS 4,122,965 A * 10/1978 Roy ..... 215/344
(Continued)

FOREIGN PATENT DOCUMENTS

CN 1429168 7/2003
(Continued)

OTHER PUBLICATIONS

Office Action issued by the Chinese Patent Office on the counterpart Chinese Patent Application No. 200480011394.5.

(Continued)

*Primary Examiner* — Anthony Stashick
*Assistant Examiner* — James N Smalley
(74) *Attorney, Agent, or Firm* — Knobbe Martens Olson & Bear LLP

(57) ABSTRACT

The present invention provides a synthetic resin cap comprising: a cap body (4) having a top plate portion (2) and a cylinder portion (3) hanging from a circumferential edge portion (2*b*) thereof; an annular inside seal projection (12) to be fitted to a container mouth portion (21); a connector portion (15) formed between the top plate portion (2) and the inside seal projection (12); and an outside thin wall portion (16) formed on the top plate portion (2), and provides a closing device using thereof, and a container-packed beverage.

When the internal pressure of the container has risen, the top plate portion (2) is deformably swelled upward, and an inward tensile force is applied to the inside seal projection (12) by the connector portion (15). Since the outside thin wall portion (16) undergoes bending deformation, the portion positioned inside the outside thin wall portion (16) to undergo significant bulging deformation upward, and the slope of the top plate portion (2) at the portion where the inside seal projection (12) is formed is increased. Thus, the inside seal projection (12) is displaced inward, and gas in the container may be easily discharged to the outside.

15 Claims, 4 Drawing Sheets

U.S. PATENT DOCUMENTS

| | | | | |
|---|---|---|---|---|
| 4,564,112 | A | 1/1986 | Breuer | |
| 5,803,286 | A | 9/1998 | Pfefferkorn et al. | |
| 6,021,912 | A * | 2/2000 | Hertrampf | 215/344 |
| 6,679,395 | B1 * | 1/2004 | Pfefferkorn et al. | 215/307 |
| 7,314,146 | B2 * | 1/2008 | Mavin | 215/307 |
| 2001/0027957 | A1 * | 10/2001 | Kano | 215/341 |
| 2006/0138071 | A1 | 6/2006 | Tsutsumi et al. | |

FOREIGN PATENT DOCUMENTS

| | | | |
|---|---|---|---|
| DE | 196 13 830 | A1 | 5/1997 |
| DE | 296 23 290 | | 2/1998 |
| EP | 1 481 908 | | 1/2004 |
| EP | 1 481 908 | | 12/2004 |
| JP | 07-206018 | | 8/1995 |
| JP | 2001-328653 | | 11/2001 |
| JP | 2002-211605 | | 7/2002 |
| JP | 2003-191984 | | 7/2003 |
| JP | 2003-200959 | | 7/2003 |
| JP | 2003-261155 | | 9/2003 |
| WO | WO 03/074380 | A1 | 9/2003 |

OTHER PUBLICATIONS

An English translation of the Chinese Patent Office Action regarding Chinese Patent Application No. 20048011394.5.

An English translation of Japanese Patent No. 2001-328653.

Office Action dated Jan. 22, 2008 in counterpart Canadian Application No. 2,623,993.

International Search Report from PCT priority application serial No. PCT/JP2004/011120.

Government of India Patent Office; Office Action for Application No. 1983/KOLNP/2005; dated Nov. 30, 2009.

The European Search Report issued in corresponding European Patent Application No. EP 04771168.4, dated Jul. 27, 2009.

* cited by examiner

SYNTHETIC RESIN CAP, CLOSING DEVICE, AND CONTAINER-PACKED BEVERAGE

This application is the U.S. National Phase under 35 U.S.C. §371 of International Application PCT/JP2004/011120, filed Jul. 28, 2004, which claims priority to Japanese Patent Application No. 2003-328992, filed Sep. 19, 2003. The International Application was published under PCT Article 21(2) in a language other than English.

TECHNICAL FIELD

The present invention relates to a synthetic resin cap that closes a container mouth portion, a closing device using the cap, and a container-packed beverage.

Priority is claimed on Japanese Patent Application No. 2003-328992, the content of which is incorporated herein by reference.

BACKGROUND ART

Conventionally, many conventional synthetic resin caps have been used provided a top plate portion and a cylinder portion hanging from the circumferential edge thereof, with an annular inside seal projection to be fitted into the container mouth portion protrudingly formed on the inner surface of the top plate portion (refer for example to Japanese Unexamined Patent Application No. 2002-211605).

FIG. 6A and FIG. 6B show an example of a synthetic resin cap having an inside seal projection, the cap 31 including a cap body 4 having a top plate portion 2 and a cylinder portion 3 hanging from a circumferential edge portion 2*b* thereof.

The horizontal score 6 demarcates the cylinder portion 3 into a main portion 8 and a tamper evidence ring portion (TE ring portion) 9 connected to the main portion 8 by bridges 7.

On the inner surface of the main portion 8, a thread portion 10 is formed for threaded engagement with a male screw 22 formed on an outer surface 21*c* of a container mouth portion 21.

On the inner surface of the TE ring portion 9 are provided tabs 11 that block movement of the TE ring portion 9 by locking to the container mouth portion when opening the cap 1.

On the inner surface 2*a* of the top plate portion 2 is formed an annular inside seal projection 12 to be fitted into the container mouth portion 21. On the outer surface of the tip portion of the inside seal projection 12 is formed an annular abutting convex portion 12*a* to abut the container inner surface 21*a*.

On the top plate portion 2 are formed an opening end seal projection 13 to abut an opening end face 21*b* of a container mouth portion 21 and an outside seal projection 14 to abut the outer surface 21*c* of the container mouth portion 21.

DISCLOSURE OF THE INVENTION

When the cap is opened and then closed again (hereafter, recapped), the internal pressure of the container increases due to fermentation of the content liquid and the like, in which case there has been the problem of the cap readily coming off the container.

For this reason, technology has been desired that can discharge gas in the container to the outside to lower the internal pressure of the container when the internal pressure of the container has risen after recapping.

The present invention was achieved in view of these circumstances, and has as its object providing a synthetic resin cap that can prevent an excessive increase in the internal pressure of a container when the cap is opened and then closed again, a closing device and a container-packed beverage.

The synthetic resin cap of the present invention is characterized by including a cap body having a top plate portion and a cylinder portion hanging from a circumferential edge portion thereof, an annular inside seal projection to be fitted into a container mouth portion being formed on an inner surface of the top plate portion, a connector portion that connects the top plate portion and the inside seal projection being formed between the inner surface of the top plate portion and an inner surface of the inside seal projection, and an outside thin wall portion formed thinner than the circumferential edge portion being formed on the top plate portion at any position between a portion where the inside seal projection is formed and the circumferential edge portion.

In the synthetic resin cap of the present invention, a cross-sectional radius of curvature at an inner surface side of a junction portion of the top plate portion and the cylinder portion is preferably not less than 0.6 mm.

In the synthetic cap of the present invention, the top plate portion at the portion corresponding to inside of the inside seal projection has an outer circumferential side portion where the connector portion is formed and an inside thin wall portion that is formed to the inside of the outer circumferential side portion, with the inside thin wall portion preferably being formed thinner than the outer circumferential side portion.

A thickness of the outer circumferential side portion is preferably 0.5 mm to 3 mm.

A width of the outer circumferential side portion is preferably 0.5 mm to 10 mm.

In the synthetic resin cap of the present invention, when attached to the container mouth portion, it is preferable that a distance between an inner surface of the cylinder portion and a tip of a male screw formed on an outer surface of the container mouth portion be not more than 1 mm.

In the synthetic resin cap of the present invention, when attached to the container mouth portion it is preferable that a distance between a tip of a thread portion formed in the cylinder portion and the outer surface of the container mouth portion be not more than 1 mm.

In the synthetic resin cap of the present invention, it is preferable that an opening end seal projection to abut an opening end face of the container mouth portion be formed on the top plate portion.

In the synthetic resin cap of the present invention, it is preferable that the inside seal projection be made to abut the inner surface of the container mouth portion at a maximum outer diameter portion and that the height position of the maximum outer diameter portion be set so that the difference in height of the maximum outer diameter portion and the bottom end of the opening end seal projection is 1 mm to 4 mm.

In the synthetic resin cap of the present invention, it is preferable that an outside seal projection to abut the outer surface of the container mouth portion be formed on the top plate portion and that the outside seal projection be formed so that the difference in height of the bottom end of this projection and the bottom end of the opening end seal projection is not more than 3 mm.

It is preferable that the flexural modulus of the top plate portion be 500 to 2,000 MPa.

It is preferable that the density of the material constituting the synthetic resin cap be 0.85 to 0.97 g/cm$^3$.

The closing device of the present invention is characterized by including a container and a synthetic resin cap attached to a mouth portion thereof, the synthetic resin cap including a cap body having a top plate portion and a cylinder portion hanging from a circumferential edge portion thereof, an annular inside seal projection to be fitted into the container mouth portion being formed on an inner surface of the top plate portion, a connector portion that connects the top plate portion and the inside seal projection being formed between the inner surface of the top plate portion and the inner surface of the inside seal projection, and an outside thin wall portion thinner than the circumferential edge portion being formed at any position between the portion where the inside seal projection is formed and the circumferential edge portion.

The container-packed beverage of the present invention is a container packed beverage in which a beverage is filled in a closing device including a container and a synthetic resin cap attached to the mouth portion thereof, characterized by the synthetic resin cap including a cap body having a top plate portion and a cylinder portion hanging from the circumferential edge portion thereof, an annular inside seal projection to be fitted into the container mouth portion being formed on the inner surface of the top plate portion, a connector portion that connects the top plate portion and the inside seal projection being formed between the inner surface of the top plate portion and the inner surface of the inside seal projection, and an outside thin wall portion thinner than the circumferential edge portion being formed on the top plate portion at any position between the portion where the inside seal projection is formed and the circumferential edge portion.

BEST MODE FOR CARRYING OUT THE INVENTION

Figure 1:
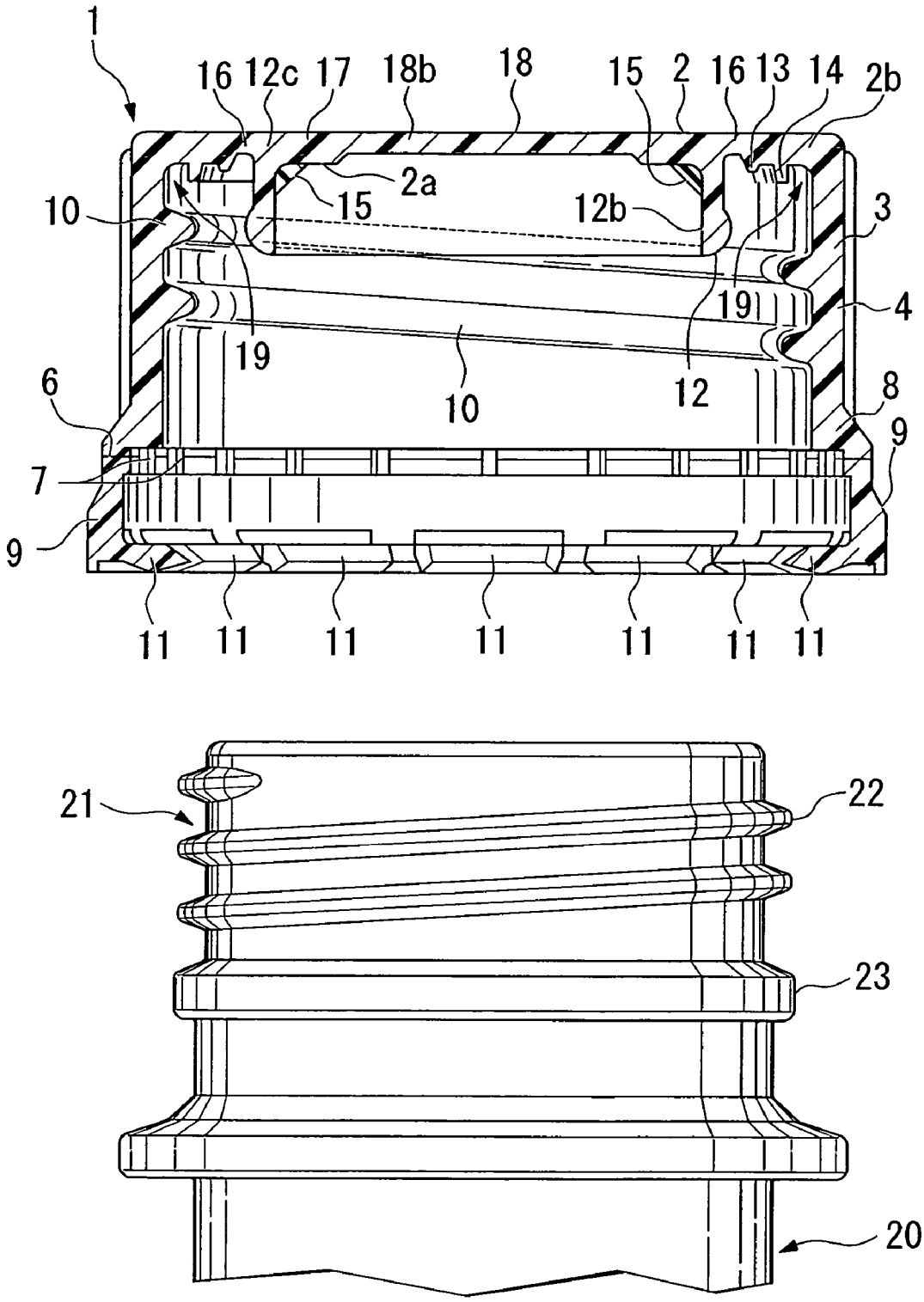
FIG. 1 is a partial cross sectional view showing one embodiment of a closing device of the present invention.
Figure 2:
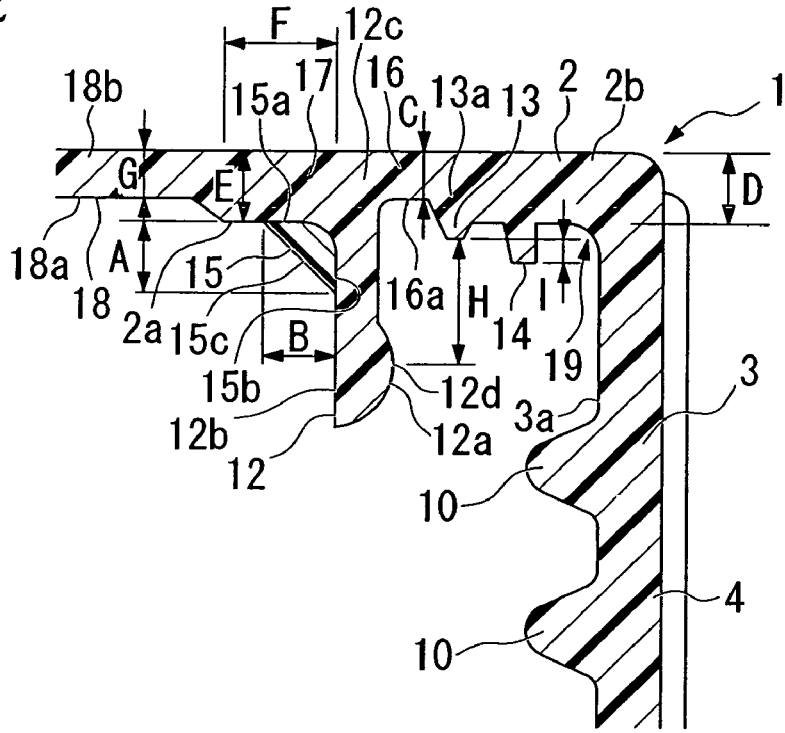
FIG. 2 is a main part enlarged view showing a synthetic resin cap of the closing device shown in FIG. 1.
Figure 3:
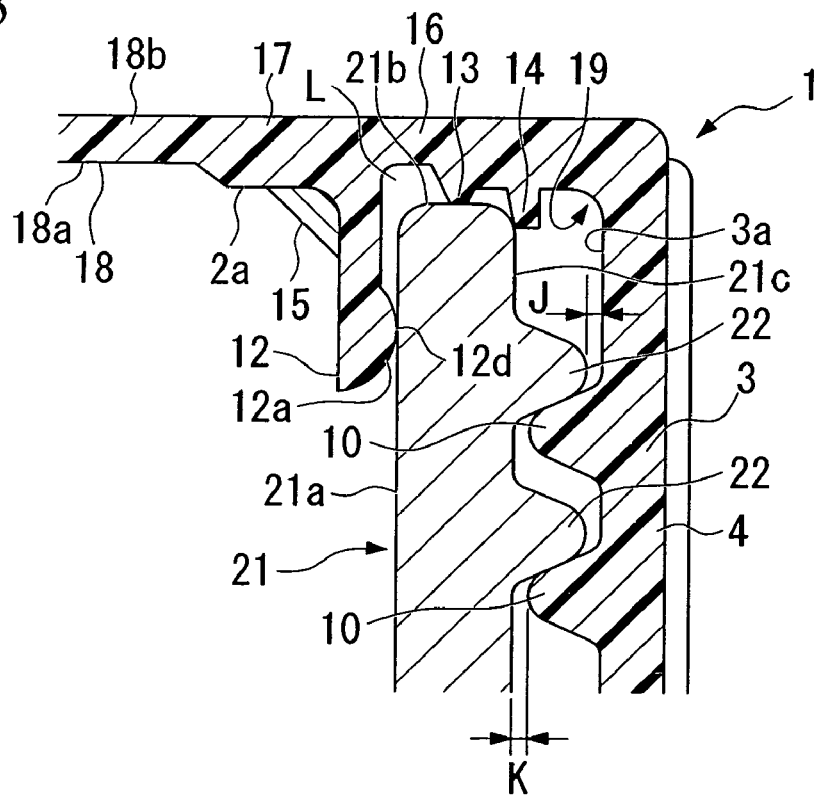
FIG. 3 is a cross sectional view showing the state of the synthetic resin cap shown in FIG. 1 attached to a container mouth portion.
Figure 4:
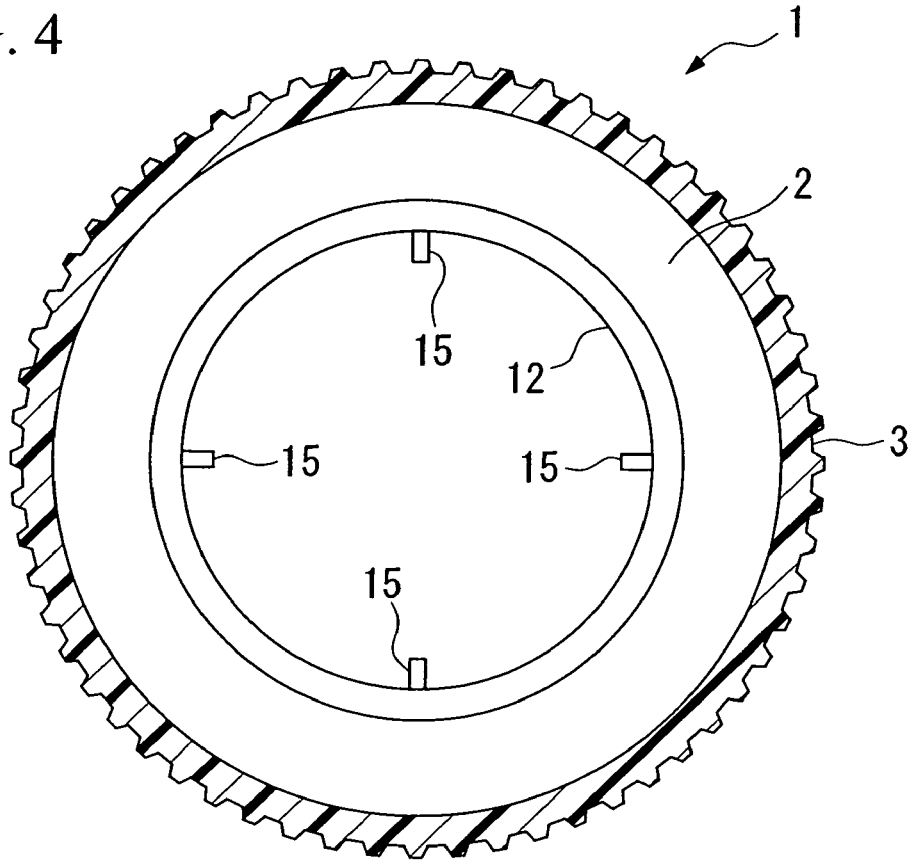
FIG. 4 is a transverse cross sectional view showing the synthetic resin cap shown in FIG. 1.

FIG. 1 shows an embodiment of a closing device of the present invention. FIGS. 2 to 4 show a synthetic resin cap used in the closing device.

The closing device shown in FIG. 1 is constituted from a container 20 and a synthetic resin cap 1 attached to a mouth portion 21 thereof. In the explanation below, inward and outward mean inward and outward in the radial direction of the cap 1.

The container 20 may be used made of a synthetic resin such as polyethylene terephthalate (PET), glass, metal or the like.

The cap 1 has a cap body 4 having a top plate portion 2 and a cylinder portion 3 hanging from a circumferential edge portion 2*b* thereof.

The cylinder portion 3 is demarcated by a horizontal score 6 (weakening line) into a main portion 8 from the horizontal score 6 upward and a tamper evidence ring portion (TE ring portion) 9 therebelow that is coupled to a bottom end of the main portion 8 by a plurality of fine bridges 7.

A thread portion 10 is formed on an inner surface of the main portion 8 for threaded engagement with a male screw 22 formed on an outer surface 21*c* of the container mouth portion 21.

Tabs 11 that are locking means to prevent movement of the TE ring portion 9 by locking with a bulging step portion 23 on the container mouth portion 21 when opening the cap 1 are provided on an inner wall surface of the TE ring portion 9. The tabs 11 are formed in a plate shape that may rise and fall.

As shown in FIG. 2 and FIG. 3, an annular inside seal projection 12 that is fitted into the container mouth portion 21 is protrudingly formed facing downward on an inner surface 2*a* of the top plate portion 2.

An annular abutting convex portion 12*a* that abuts a container inner surface 21*a* is formed on an outer surface of a tip of the inside seal projection 12.

The inside seal projection 12 is formed so that when fit in the container mouth portion 21*a* maximum outer diameter portion 12*d* of the abutting convex portion 12*a* abuts the container inner surface 21*a* without clearances to be able to tightly seal the container mouth portion 21.

The outer diameter of the maximum outer diameter portion 12*d* is preferably set to be slightly greater than the inner diameter of the container mouth portion 21.

An opening end seal projection 13 that abuts an opening end face 21*b* of the container mouth portion 21 and an outside seal projection 14 that abuts the outer surface 21*c* of the container mouth portion 21 are formed on the top plate portion 2 outward of the inside seal projection 12.

A connector portion 15 that couples the top plate portion 2 and the inside seal projection 12 is formed between the inner surface 2*a* of the top plate portion 2 and the inner surface 12*b* of the inside seal projection 12.

The connector portion 15 firmly fixes the inside seal projection 12 to the top plate portion 2 and maintains a constant angle of the inside seal projection 12 with respect to the top plate portion 2.

In the example illustrated, the connector portion 15 is a substantially triangular plate nearly perpendicular to the top plate portion 2 formed in the radial direction. A top edge portion 15*a* of the connector portion 15 is integrally fixed to the top plate portion inner surface 2*a*, and a side edge portion 15*b* is integrally fixed to the inner surface 12*b* of the inside seal projection. An inner edge portion 15*c* of the connector portion 15 preferably has a shape descending gradually as outwardly.

It is preferable for the connector portion 15 to be integrally formed with the top plate portion 2 and the inside seal projection 12.

As shown in FIG. 2, it is preferable for a height A of the connector portion 15 to be 0.5 mm to 5 mm (preferably 1 mm to 4 mm).

When the height A is less than the aforementioned range, discharge of the gas in the container 20 is hindered when the internal pressure rises. When the height A exceeds the aforementioned range, deformation of the inside seal projection 12 is hindered when fitted into the container mouth portion 21, thereby losing the ease of the closing operation. In addition, the mold releasability at forming worsens.

It is preferable for a width B in the radial direction of the connector portion 15 to be 0.1 to 3 mm (preferably 0.3 mm to 1 mm).

When the width B is less than the aforementioned range, discharge of the gas in the container 20 is hindered when the internal pressure rises. When the width B exceeds the aforementioned range, deformation of the inside seal projection 12 is hindered when fitted into the container mouth portion 21, thereby losing the ease of the closing operation. In addition, the mold releasability at forming worsens.

The connector portion is not limited to the illustrated shape, and may be made into an optional shape such as a square plate shape, fan plate shape, rectangular shape, and pyramid shape.

As shown in FIG. 4, it is preferable for the connector portion 15 to be formed not along the entire circumference of the top plate portion 2 and the inside seal projection 12, but only in partly portions in the circumferential direction.

In the illustrated example, the connector portions 15 are provided in four places spaced out in the circumferential direction. The connector portions 15 are provided so that the distances between the two mutually adjacent connector portions 15 are roughly equivalent.

It is preferable for the number of the connector portions 15 to be formed to be 1 to 6 (preferably 1 to 4).

Having the number of connector portions 15 in this range causes the aforementioned tensile force to act on the inside seal projection 12 biased in the circumferential direction, thereby facilitating deformability of the inside seal projection 12 inward. Accordingly, when the internal pressure of the container rises, the gas in the container 20 may be easily discharged to the outside.

When the formed number exceeds the aforementioned range, deformation of the inside seal projection 12 is hindered when the internal pressure of the container rises, thereby hindering the discharge of the gas in the container 20.

As shown in FIG. 2, an annular thin concave portion 16*a* is formed on the bottom surface of the top plate portion 2 between the portion 12*c* where the inside seal projection 12 is formed and the portion 13*a* where the open end seal projection 13 is formed. The portion of the top plate portion 2 where the thin concave portion 16*a* is formed is an outside thin wall portion 16 formed thinner than the circumferential edge portion 2*b* and the outer circumferential side portion 17.

The outside thin wall portion 16 is formed in an adjacent position outward of the portion 12*c* where the inside seal projection 12 is formed.

The outside thin wall portion may be formed at any position between the portion 12*c* where the inside seal projection 12 is formed and the circumferential edge portion 2*b*, with the forming position thereof not limited by the illustrated example. In addition, the outside thin wall portion may be formed by a thin concave portion provided on the top surface of the top plate portion.

The outside thin wall portion 16 is formed so that a thickness C thereof is less than a thickness D of the circumferential edge portion 2*b* of the top plate portion 2.

When the thickness C of the outside thin wall portion 16 is equal to or greater than the thickness D of the circumferential edge portion 2*b*, discharge of the gas in the container 20 is hindered when the internal pressure of the container rises.

It is preferable for the thickness C of the outside thin wall portion 16 to be 0.3 mm to 2 mm (preferably 0.5 mm to 1.5 mm).

Having the thickness C in the aforementioned range facilitates bending deformation of the outside thin wall portion 16, bulging deformation of the top plate portion 2 at the portion corresponding to the inside of the inside seal projection 12, and discharge of the gas in the container 20 when the internal pressure of the container rises.

When the thickness C is less than the aforementioned range, the strength of the outside thin wall portion 16 becomes too low, and when it exceeds this range discharge of the gas in the container 20 is hindered when the internal pressure of the container rises.

It is preferable for the thickness C of the outside thin wall portion 16 to be set to a value corresponding to 0.3 to 0.9 times the thickness D of the circumferential edge portion 2*b*. When the thickness C is less than this range, the strength of the outside thin wall portion 16 becomes too low, and when it exceeds this range, discharge of the gas in the container 20 is hindered when the internal pressure of the container rises.

It is desirable for the thickness D of the top plate portion 2 at the circumferential edge portion 2*b* be 0.5 mm to 3 mm (preferably 0.8 mm to 2 mm).

The top plate portion 2 at the portion corresponding to the inside of the inside seal projection 12 has an outer circumferential portion 17 where the connector portion 15 is formed and an inner circumferential portion 18.

It is desirable for a thickness E of the outer circumferential portion 17 be 0.5 mm to 3 mm (preferably 0.8 mm to 2 mm).

Having the thickness E in the aforementioned range may impart sufficient strength to this portion. Consequently, the action that displaces the inside seal projection 12 by the connector portion 15 when the pressure in the container increases is enhanced, which may facilitate discharge of the gas in the container 20.

When the thickness E is less than the aforementioned range, the strength of the top plate portion 2 becomes too low, the action that displaces the inside seal projection 12 by the connector portion 15 diminishes, and so the discharge of the gas in the container 20 is hindered when the internal pressure of the container rises. When the thickness E exceeds this range, bulging deformation of the top plate portion 2 is hindered, and so the discharge of the gas in the container 20 is hindered when the internal pressure of the container rises.

It is preferable for a width F of the outer circumferential portion 17 to be 0.5 mm to 10 mm (preferably 2 mm to 7 mm).

Having the width F in the aforementioned range enhances the action that displaces the inside seal projection 12 by the connector portion 15, and may thereby facilitate the discharge of the gas in the container 20 to the outside when the internal pressure of the container rises.

When the width F is less than the aforementioned range, the action that displaces the inside seal projection 12 due to the connector portion 15 diminishes, hindering discharge of the gas in the container 20 when the internal pressure of the container rises. When the width F exceeds the aforementioned range, bulging deformation of the top plate portion 2 is hindered, and so the discharge of the gas in the container 20 is hindered when the internal pressure of the container rises.

A thinned concave portion 18*a* is formed on the inner surface of the inner circumferential portion 18. Thereby, the inner circumferential portion 18 becomes the inside thin wall portion 18*b* formed thinner than the outer circumferential portion 17. As shown in the illustrated embodiments of FIGS. 1-3, the outer circumferential side portion 17 and the inside thin wall portion 18*b* have a substantially constant thickness. The thinned concave portion 18*a* is preferably circular.

It is desirable for a thickness G of the inside thin wall portion 18*b* to be 0.3 mm to 2 mm (preferably 0.5 mm to 1.5 mm).

Having the thickness G in the aforementioned range facilitates bulging deformation of the top plate portion 2, whereby displacement of the inside seal projection 12 occurs easily. Consequently, discharge of the gas in the container 20 is facilitated when the internal pressure of the container rises.

When the thickness G is less than the aforementioned range, the strength of the inside thin wall portion 18*b* becomes too low, thereby degrading the durability of the cap 1. When the thickness G exceeds this range, bulging deformation of the top plate portion 2 is hindered, and so discharge of the gas is hindered when the internal pressure of the container rises.

In the illustrated example, the entire inner circumferential portion 18 assumes the inside thin wall portion 18*b* formed thinner than the outer circumferential portion 17, but in the present invention, only a portion of the inner circumferential portion 18 may be thinned. To wit, the annular thinned concave portion may be formed at only the portion near the circumferential edge of the inner circumferential portion 18, and this annular portion may serve as the inside thin wall portion.

It is preferred for the height of the maximum outer diameter portion 12*d* of the inside seal projection 12 to be set so that a difference in height H between the maximum outer diameter portion 12*d* and the bottom end of the open end seal projection 13 is 1 mm to 4 mm (preferably 1.5 mm to 3 mm).

Having the difference in height H in the aforementioned range may facilitate discharge of the gas in the container when the internal pressure of the container rises and enhance tamper evidence.

When the difference in height H is less than the aforementioned range, displacement of the inside seal projection 12 is hindered during bulging deformation of the top plate portion 2 when the internal pressure of the container rises, thereby hindering discharge of the gas in the container. It is also not preferred from the aspect of tamper evidence because seal breakage during the opening process occurs earlier.

When the difference in height H exceeds the aforementioned range, the seal breakage during the opening process is delayed, giving rise to the risk of the cap 1 readily coming off by the internal pressure of the container.

It is preferable that the protruding height of the outside seal projection 14 be set so that a difference in height I between the bottom end of the projection 14 and the bottom end of the opening end seal projection 13 is 3 mm or less (preferably 1.5 mm or less).

Having the difference in height I in the aforementioned range facilitates discharge of the gas in the container when the internal pressure of the container rises.

When the difference in height I exceeds this range, detachment of the outside seal projection 14 from the container mouth portion 21 is hindered during bulging deformation of the top plate portion 2 when the internal pressure of the container rises, and thereby hinders discharge of the gas from inside the container.

In consideration of the sealing property, it is preferred that the difference in height I be set so as to be not less than 0.2 mm (preferably not less than 0.3 mm).

The cross-sectional radius of curvature of a junction portion 19 that is the portion where the top plate portion 2 and the cylinder portion 3 are joined is preferably not less than 0.6 mm (preferably not less than 0.8 mm).

Having the radius of curvature in the aforementioned range increases the strength of the junction portion 19, which may hinder displacement of the top plate portion 2 at the portion corresponding to the outside of the outside thin wall portion 16 when the internal pressure of the container rises.

Consequently, the top plate portion 2 at the portion corresponding to the inside of the outside thin wall portion 16 is greatly bulged and the slope of the top plate portion 2 at the portion 12*c* where the inside seal projection 12 is formed is increased, facilitating inward displacement of the inside seal projection 12. Accordingly, discharge of the gas in the container is facilitated.

When the radius of curvature less than the aforementioned range, inward displacement of the inside seal projection 12 is hindered, thereby hindering the discharge of the gas in the container.

The aforementioned radius of curvature is preferably not more than 2 mm. When the radius of curvature exceeds the aforementioned range, separation of the opening end seal projection 13 and the outside seal projection 14 from the container mouth portion 21 is hindered, thereby hindering the discharge of the gas in the container.

A distance J between an inner surface 3*a* of the cylinder portion 3 (base end of the thread portion 10) and the male screw 22 when the cap 1 is attached to the container mouth portion 21 is preferably not more than 1 mm (preferably 0.1 mm to 0.5 mm).

Having the distance J in the aforementioned range enhances the holding power of the cap 1 with respect to the container mouth portion 21, which may prevent the cap 1 from coming off the container mouth portion 21 when opening.

When the distance J is less than the aforementioned range, attachment of the cap 1 to the container mouth portion 21 may be hindered. When the distance J exceeds the aforementioned range, the cap 1 readily comes off the container mouth portion 21 during opening.

A distance K between the tip of the thread portion 10 and the outer surface 21*c* of the container mouth portion 21 is preferably not more than 1 mm (preferably 0.1 mm to 0.5 mm).

Having the distance K in the aforementioned range enhances the holding power of the cap 1 with respect to the container mouth portion 21, which may prevent the cap 1 from coming off the container mouth portion 21 when opening.

When the distance K is less than the aforementioned range, attachment of the cap 1 to the container mouth portion 21 may be hindered. When the distance K exceeds the aforementioned range the cap 1 readily comes off the container mouth portion 21 during opening.

The synthetic resin material constituting the cap 1 may include a material containing polypropylene or polyethylene.

It is preferable that the flexural modulus of the top plate portion 2 be 500 to 2,000 MPa (preferably 1,000 to 1,800 MPa).

Having the flexural modulus in the aforementioned range may facilitate discharge of the gas in the container when the internal pressure of the container is increased and prevent breakage of the cap 1. Doing so also enhances the holding power with respect to the container mouth portion 21, which may prevent the cap 1 from readily coming off during opening.

When the flexural modulus is less than the aforementioned range, cracking readily occurs in the top plate portion 2.

When the flexural modulus exceeds the aforementioned range, displacement of the inside seal projection 12 is hindered when the internal pressure of the container is increased, thereby hindering discharge of the gas in the container. Also, the cap 1 readily comes off during opening.

It is preferable for the density of the material constituting the cap 1 to be 0.85 to 0.97 g/cm$^3$ (preferably 0.87 to 0.95 g/cm$^3$).

Having the density in the aforementioned range may facilitate discharge of the gas in the container when the internal pressure of the container is increased and may prevent breakage of the cap 1. Doing so also enhances the holding power with respect to the container mouth portion 21, which may prevent the cap 1 from readily coming off during opening.

When the density is less than the aforementioned range, displacement of the inside seal projection 12 is hindered when the internal pressure of the container is increased, thereby hindering discharge of the gas in the container. Also, the cap 1 readily comes off during opening. When the density exceeds the aforementioned range, cracking readily occurs in the cap 1.

Below, the method of using the cap 1 is explained referring to FIG. 3 and FIG. 5.

The cap 1 is attached to the mouth portion 21 of the container 20 filled with a content liquid as shown in FIG. 3. At this time, the inside seal projection 12 is inserted in the container mouth portion 21.

The inside seal projection 12 abuts the container inner surface 21*a* at the abutting convex portion 12*a*, sealing this portion. By doing so the container 20 is hermetically sealed.

In this hermetically sealed state (when unopened), the opening end seal projection 13 abuts the opening end face 21*b* and the outside seal projection 14 abuts the container outer surface 21*c*.

Also, the tabs 11 provided on the TE ring portion 9 surmount the annular bulging step portion 23 provided directly under the male screw 22, reaching below the bulging step portion 23.

When the cap 1 attached to the container mouth portion 21 is rotated in the opening direction, the cap 1 rises, the inside seal projection 12 is pulled out of the container mouth portion 21, and the hermetic seal of the container 20 is broken.

Because at this time the tabs 11 provided on the inner surface of the TE ring portion 9 lock with the lower portion of the bulging step portion 23, while the main portion 8 rises in accordance with the rotation, upward movement of the TE ring portion 9 is blocked. Consequently, tensile force acts on the bridge 7 connecting the main portion 8 and TE ring portion 9 of the cap 1, by which the bridges 7 break, and the TE ring portion 9 is detached from the main portion 8. By detaching the TE ring portion 9, it is evident that the cap 1 is opened.

When the cap 1 is opened and then recapped, the internal pressure of the container 20 may rise considerably (for example, 0.4 MPa or more) due to fermentation of the content liquid and the like.

When the pressure in the container 20 rises, upward force acts on the top plate portion 2 due to the internal pressure of the container.

Figure 5:
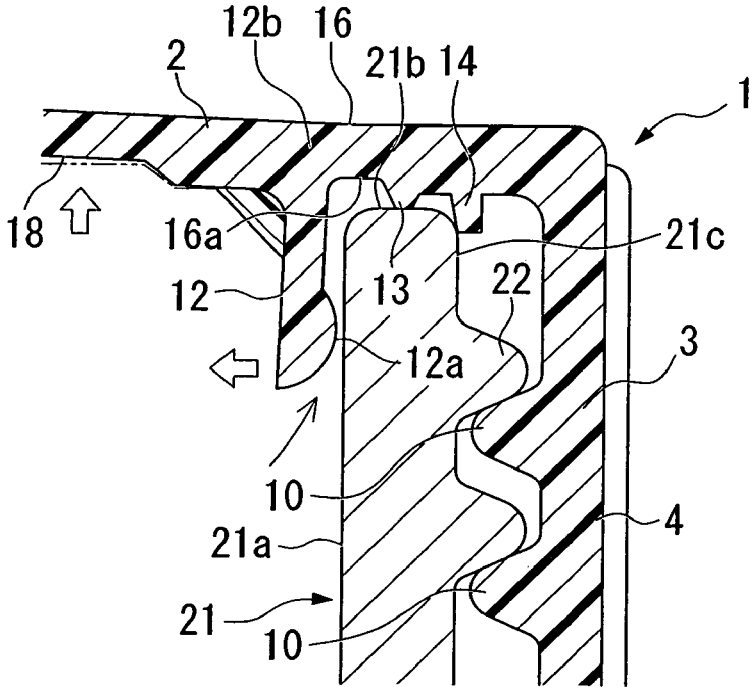
FIG. 5 is an enlarged view showing a main part of the synthetic resin cap shown in FIG. 1.
Figure 6A:
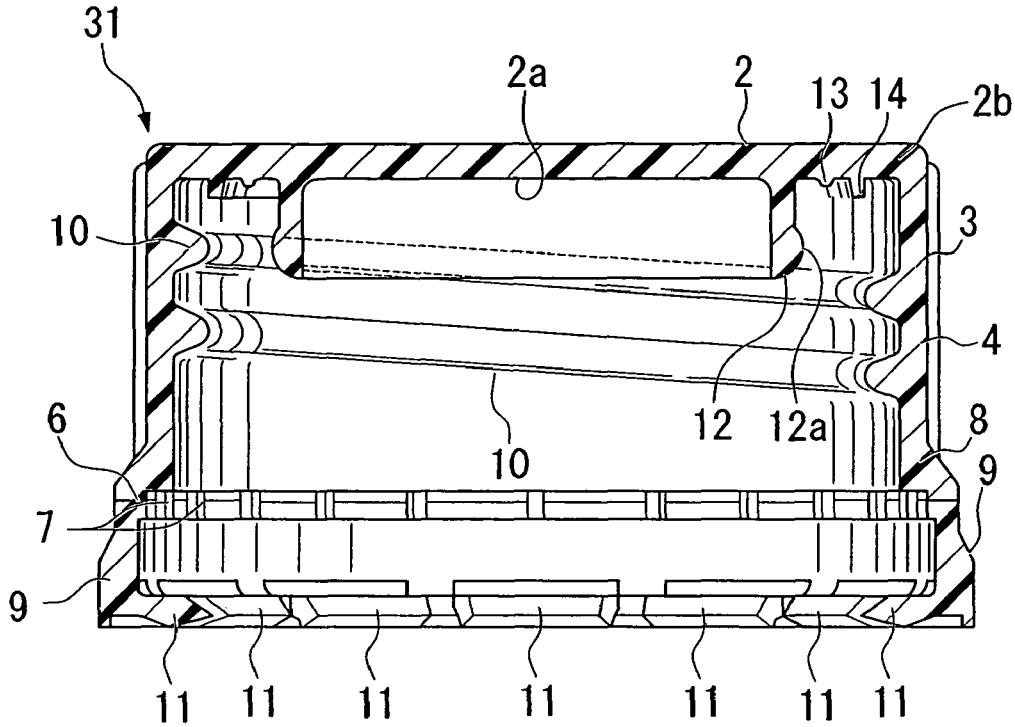
FIG. 6A is an overall view showing an example of a conventional synthetic resin cap.
Figure 6B:
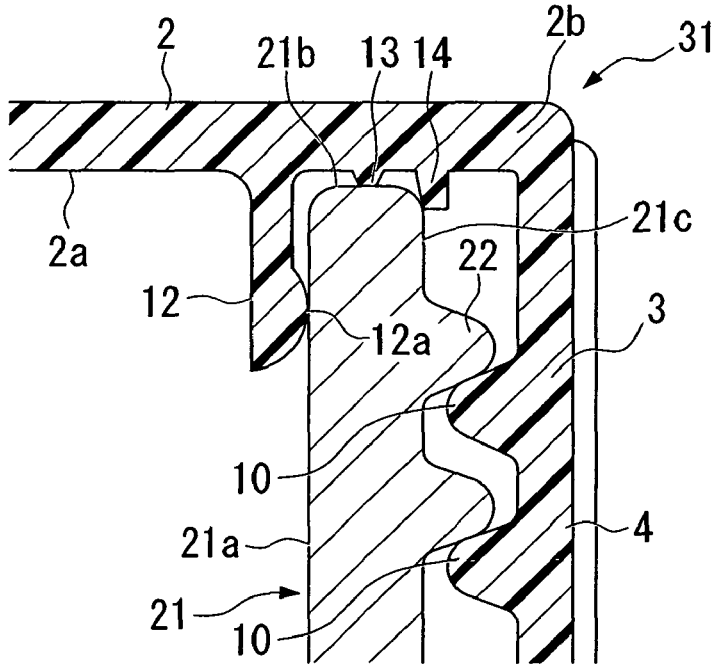
FIG. 6B is an enlarged view showing a main part of the state of the synthetic resin cap shown in FIG. 6A attached to a container mouth portion.

As shown in FIG. 5, applying force upwardly to the top plate portion 2 from the internal pressure of the container causes upward bulging deformation (so-called doming) of the top plate portion 2.

Along with the bulging deformation of the top plate portion 2, top edge portions 15*a* of the connector portions 15 are displaced upward, and as a result, tensile force is applied inwardly on the inside seal projection 12 by the connector portions 15.

The bulging deformation of the top plate portion 2 causes the center portion thereof to rise. Whereby, the top plate portion 2 assumes a sloped state descending gradually from the center portion thereof heading outward.

Because the strength of the top plate portion 2 is lower at the outside thin wall portion 16, when an upward force is applied on the top plate portion 2 from the internal pressure of the container, the top plate portion 2 undergoes bending deformation at the outside thin wall portion 16, and the portion inward of the outside thin wall portion 16 undergoes significant bulging deformation upward.

Due to the slope of the top plate portion 2 during bulging deformation (the slope with respect to the top plate portion 2 when undeformed) being greater nearer the circumferential edge of the deformed portion, the slope of the top plate portion 2 inward of the outside thin wall portion 16 is greater nearer the outside thin wall portion 16.

Consequently, the slope of the top plate portion 2 at the portion 12*c* where the inside seal projection 12 is formed increases compared to the case of the entire top plate-portion 2 deformably swelling.

Moreover, due to the strength of the junction portion 19 being sufficiently raised by its cross-sectional radius of curvature being within the aforementioned range, the top plate portion 2 at the portion corresponding to the outside of the outside thin wall portion 16 is hindered from deforming upward.

Consequently, the portion positioned inward of the outside thin wall portion 16 deformably swells upward to a greater extent, and the slope of the top plate portion 2 at the portion 12*c* where the inside seal projection 12 is formed further increases.

In this way, due to inward tensile force being applied to the inside seal projection 12 by the connector portions 15 and the top plate portion 2 (the portion 12*c* where the inside seal projection 12 is formed) greatly sloping, at least a portion of the inside seal projection 12 is displaced in the direction of inward movement of the tip, and the abutting convex portion 12*a* separates from the container inner surface 21*a*.

This causes the gas in the container 20 to be discharged to the outside through the gap between the container inner surface 21*a* and the inside seal projection 12.

The aforementioned cap 1 exhibits the following effects:

(1) By having connector portions 15 formed between the top plate portion 2 and the inside seal projection 12, sloping of the top plate portion 2 by bulging deformation due to rising of the internal pressure of the container causes inward tensile force to be applied to the inside seal projection 12.

Also, because the outside thin wall portion 16 is formed on the top plate portion 2, the top plate portion 2 undergoes bending deformation at the outside thin wall portion 16, causing the portion positioned inside the outside thin wall portion 16 to undergo significant bulging deformation upward.

Because of this, the slope of the top plate portion 2 at the portion 12*c* where the inside seal projection 12 is formed increases compared to the case of the entire top plate portion 2 deformably swelling.

Consequently, the inside seal projection 12 is displaced in the direction of inward movement of the tip, facilitating discharge of the gas in the container 20 through the gap between the container inner surface 21*a* and the inside seal projection 12.

Accordingly, the cap 1 may prevent an excessive increase in the internal pressure of the container 20 after recapping.

In the case of the outside thin wall portion 16 not being formed, when the internal pressure of the container rises, because the entire top plate portion 12 deformably swells, the slope of the portion 12*b* where the inside seal projection 12 is formed is lessened, thereby hindering inward displacement of the inside seal projection 12. Accordingly, discharge of the gas in the container 20 is hindered.

(2) Having the cross-sectional radius of curvature of the junction portion 19 in the aforementioned range sufficiently raises the strength of the junction portion 19, which may thereby hinder displacement of the top plate portion 2 at the portion corresponding to outside of the outside thin wall portion 16.

For this reason, the portion positioned inward of the outside thin wall portion 16 deformably swells upward to a greater extent, and so the slope of the top plate portion 2 at the portion 12*c* where the inside seal projection 12 is formed may be further increased.

Accordingly, an excessive increase in the internal pressure of the container may be surely prevented after recapping.

(3) Since the connector portion 15 is formed only in a portion of the circumferential direction, the inward tensile force acts locally only on a portion of the inside seal projection 12.

Since the tensile force acts on the inside seal projection 12 biased in the circumferential direction, the strain produced in the inside seal projection 12 by inward displacement of the inside seal projection 12 at the portions where the connector portion 15 are formed is absorbed by the portions where the connector portions 15 are not formed.

Consequently, the inside seal projection 12 at the portion where the tensile force acts is easily displaced inward, compared to the case of the connector portion being formed over the entire circumference.

(4) A common method of sterilizing the inside of a cap is to run hot water over the outer surface of the cap attached to a container mouth portion.

As shown in FIG. 3, since in the cap 1 the outside thin wall portion 16 is formed in the top plate portion 2, by supplying hot water to the outer surface of the top plate portion 2, sufficient heat can be transmitted through the outside thin wall portion 16 to an inner space L (the space surrounded by the inner seal projection 12, the top plate portion 2, the opening end seal projection 13 and the container mouth portion 21).

Accordingly, the inner space L may be surely sterilized.

By filling a beverage such as juice, tea or coffee in the container 20 and attaching the cap 1 to the mouth portion 21, a container-packed beverage filled with the beverage may be provided with the aforementioned closing device.

INDUSTRIAL APPLICABILITY

The synthetic resin cap of the present invention exhibits the following effects:

(1) By having connector portions formed between the top plate portion and the inside seal projection, sloping of the top plate portion by bulging deformation due to rising of the internal pressure of the container causes inward tensile force to be applied to the inside seal projection.

Also, because the outside thin wall portion is formed on the top plate portion, the top plate portion undergoes bending deformation at the outside thin wall portion, causing the portion positioned inside the outside thin wall portion to undergo significant bulging deformation upward.

Because of this, the slope of the top plate portion at the portion where the inside seal projection is formed increases.

Consequently, the inside seal projection is displaced in the direction of inward movement of the tip and separates from the container inner surface, thereby facilitating the discharge of the gas in the container to the outside.

Accordingly, an excessive increase in the internal pressure of the container may be prevented after recapping.

(2) Having the cross-sectional radius of curvature of the junction portion in the aforementioned range sufficiently raises the strength of the junction portion, which may thereby hinder displacement of the top plate portion at the portion corresponding to the outside of the outside thin wall portion.

For this reason, the portion positioned inward of the outside thin wall portion deformably swells upward to a greater extent, and so the slope of the top plate portion at the portion where the inside seal projection is formed may be further increased.

Accordingly, an excessive increase in the internal pressure of the container may be surely prevented after recapping.

The invention claimed is:

1. A synthetic resin cap comprising:

a cap body having a top plate portion and a cylinder portion hanging from a circumferential edge portion thereof;

an annular inside seal projection to be fitted into a container mouth portion formed on an inner surface of the top plate portion;

a connector portion that connects the top plate portion and the inside seal projection formed between the inner surface of the top plate portion and an inner surface of the inside seal projection;

an outside thin wall portion which is thinner than the circumferential edge portion formed on the top plate portion at any position between a portion where the inside seal projection is formed and the circumferential edge portion;

wherein the top plate portion at the portion corresponding to the inside of the inside seal projection has an outer circumferential side portion where the connector portion is formed, and an inside thin wall portion that is formed on the inside of the outer circumferential side portion; and wherein the cap further comprises a first transition section that transitions from the annular inside seal projection to the outer circumferential side portion in a radially inward direction and a second transition section that transitions from the outer circumferential side portion to the inside thin wall portion in a radially inward direction, wherein the inside thin wall portion is thinner than the outer circumferential side portion, which is thinner than the annular inside seal projection in a direction perpendicular to the top plate.

2. The synthetic resin cap according to claim 1, wherein:

a cross-sectional radius of curvature at the inner surface side of a junction portion of the top plate portion and the cylinder portion is not less than 0.6 mm;

a thickness of the outer circumferential side portion is 0.5 mm to 3 mm;

a width of the outer circumferential side portion is 0.5 mm to 10 mm;

an opening end seal projection to abut an opening end face of the container mouth portion is formed on the top plate portion; and an outside seal projection to abut an outer surface of the container mouth portion is formed on the top plate portion.

3. The synthetic resin cap according to claim 1, wherein when attached to the container mouth portion, a distance between an inner surface of the cylinder portion and a tip of a male screw formed on an outer surface of the container mouth portion is not more than 1 mm.

4. The synthetic resin cap according to claim 1, wherein when attached to the container mouth portion, a distance between a tip of a thread portion formed in the cylinder portion and the outer surface of the container mouth portion is not more than 1 mm.

5. The synthetic resin cap according to claim 2, wherein:

the inside seal projection is made to abut an inner surface of the container mouth portion at a maximum outer diameter portion; and the height position of the maximum outer diameter portion is set so that a difference in height of the maximum outer diameter portion and a bottom end of the opening end seal projection is 1 mm to 4 mm.

6. The synthetic resin cap according to claim 2, wherein the outside seal projection is formed so that the difference in height of a bottom end of this projection and the bottom end of the opening end seal projection is not more than 3 mm.

7. The synthetic resin cap according to claim 2, wherein the flexural modulus of the top plate portion is 500 to 2,000 MPa.

8. The synthetic resin cap according to claim 2, wherein the density of the material constituting the synthetic resin cap is 0.85 to 0.97 g/cm$^3$.

9. The synthetic resin cap according to claim 1, wherein a thickness of the inside thin wall portion is thinner than a thickness of the circumferential edge portion of the top plate portion.

10. The synthetic resin cap according to claim 1, wherein the outside thin wall portion has a thickness of 0.3 mm to 2 mm.

11. The synthetic resin cap according to claim 1, wherein the outside thin wall portion is a thin concave portion provided on a top surface of the top plate portion.

12. The synthetic resin cap according to claim 1, wherein the transition portion of the outer circumferential side portion is tapered.

13. The synthetic resin cap according to claim 1, wherein the transition portion of the inside thin wall portion is tapered.

14. The synthetic resin cap according to claim 1, wherein the transition portion of the outer circumferential side portion and the transition portion of the inside thin wall portion are tapered.

15. The synthetic resin cap according to claim 1, wherein each of the non-tapered portion of the outer circumferential side portion and the non-tapered portion of the inside thin wall portion has a constant thickness.

* * * * *